US005947081A

United States Patent [19]

Kim

[11] Patent Number: 5,947,081

[45] Date of Patent: Sep. 7, 1999

[54] AIR FLOW SYSTEM FOR INTERNAL COMBUSTION ENGINE

[76] Inventor: Sei Y. Kim, 8F Daihyun Bldg., 861-9 Anyang-2Dong, Anyang-si, Kyunggi-do, Rep. of Korea

[21] Appl. No.: 08/909,734

[22] Filed: Aug. 12, 1997

[51] Int. Cl.[6] ..... F02M 29/06; F02M 29/04

[52] U.S. Cl. ..... 123/306; 123/590; 123/593

[58] Field of Search ..... 123/306, 590, 123/592, 593, 184.21, 184.32, 184.46, 184.54; 60/902

[56] References Cited

U.S. PATENT DOCUMENTS

| | | | |
|---|---|---|---|
| 4,274,386 | 6/1981 | Reyes | 123/590 |
| 4,729,776 | 3/1988 | Elliff | 123/592 |
| 4,962,642 | 10/1990 | Kim | 123/590 |
| 5,113,838 | 5/1992 | Kim | 123/590 |
| 5,595,157 | 1/1997 | Siew et al. | 123/306 |

*Primary Examiner*—Willis R. Wolfe
*Assistant Examiner*—Hieu T. Vo

[57] ABSTRACT

An air flow system for an internal combustion engine which includes a cylindrical air cleaner, the cylindrical air cleaner divided into a centrally disposed air swirling zone and a laterally disposed filter zone; and a swirling device disposed in the air swirling zone, the swirling device including a plurality of flexible vane members which extend radially toward the periphery of the swirling device for increasing air flow, at least one elongated slit disposed in each of the plurality of vane members for preventing the generation of negative pressure behind the vane members, and at least one groove disposed on the surface of each of the plurality of vane members for preventing the generation of negative pressure behind the vane members and increasing the force of the swirling air flow, whereby when air is introduced through said filter zone and into the air swirling zone, a strong swirling force is generated which is retained by the reduced resistance created in the air flow through the vane members.

13 Claims, 2 Drawing Sheets

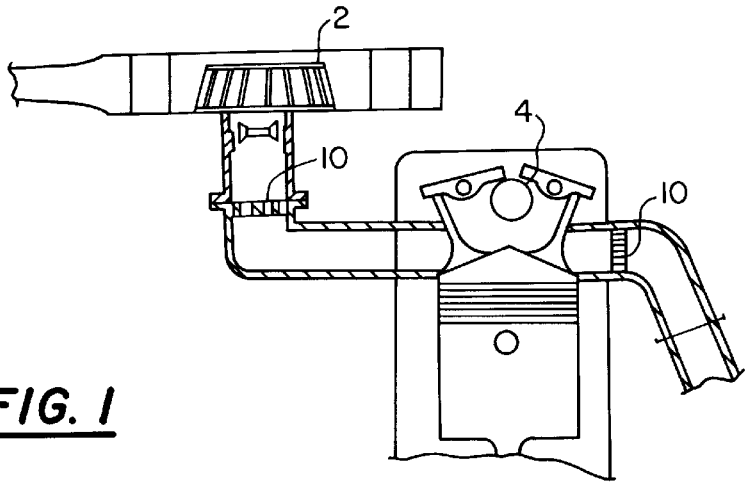
FIG. 1
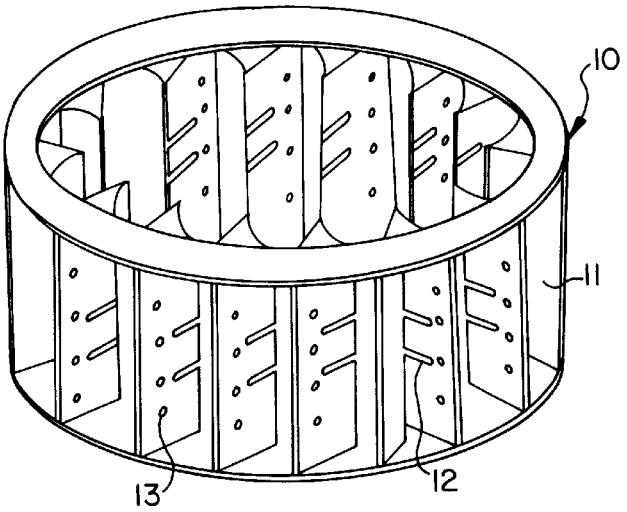
FIG. 2
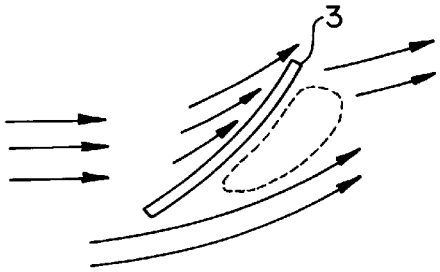
FIG. 3(A)
(CONVENTIONAL ART)
FIG. 3(B)
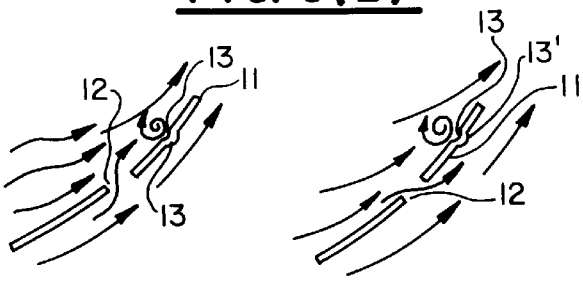

FIG. 4(A)
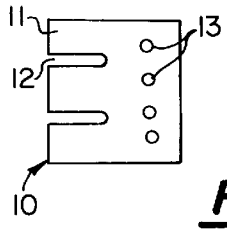
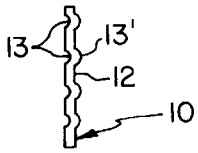
FIG. 4(B)
FIG. 5(A)
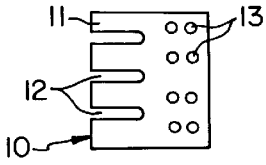
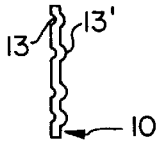
FIG. 5(B)
FIG. 6(A)
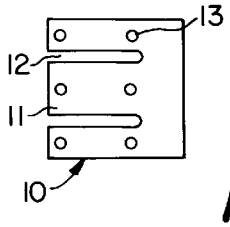
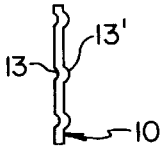
FIG. 6(B)
FIG. 7(A)
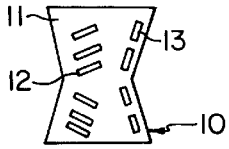
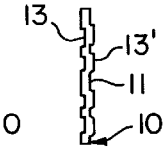
FIG. 7(B)
FIG. 8(A)
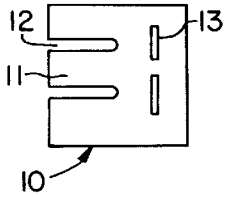
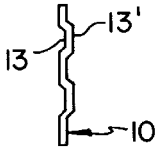
FIG. 8(B)
FIG. 9(A)
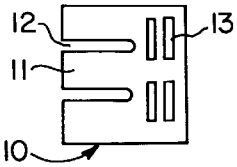
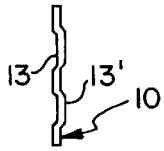
FIG. 9(B)
FIG. 10(A)
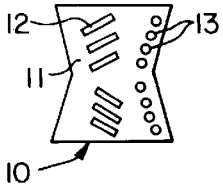
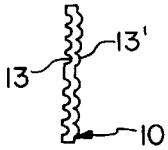
FIG. 10(B)
FIG. 11(A)
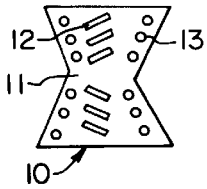
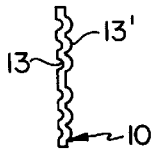
FIG. 11(B)

AIR FLOW SYSTEM FOR INTERNAL COMBUSTION ENGINE

BACKGROUND OF THE INVENTION

1. Field of the Invention

The present invention relates to an air flow device and an air flow system for an internal combustion engine and more particularly, to an air swirling device having a plurality of vanes with at least one elongated slit disposed therein, and with at least one groove having a concave configuration disposed thereon. The air swirling device is positioned within an air cleaner of an internal combustion engine for achieving complete combustion. Also, the air flow system can be used with a spark ignition internal combustion engine of the carburetor type or of the fuel injection type, as well as a diesel engine of the high compression, self-ignition type.

2. Description of the Prior Art

It is known that an increase in the swirl of the flow in the combustion chamber of an internal combustion engine improves the flame propagation speed which greatly facilitates complete combustion. However, there are many problems which accompany attempts at increasing air flow such as air resistance and the like. For example, Japanese patent publication No. 59-11722 and U.S. Pat. No. 4,309,969 disclose a simple turbulence device, which includes an intake valve having a large intake resistance so that the swirling device does not create a uniform air flow. Japanese patent publication Nos. 60-17922 and 61-10645, U.S. Pat. Nos. 4,424,777, 4,432,312, and 4,538,854 disclose a device having vanes which are disposed in the vicinity of an intake valve. Such devices have various disadvantages, such as for example, air resistance, reduced inlet air into the cylinder, varying air flows of intake manifolds and strong vibrations due to different swirl ratios and volumes of the intake air. U.S. Pat. Nos. 3,648,674 and 4,274,386 disclose a wire set and blades device disposed between a carburetor and an intake manifold. However, this device exhibits high friction so that the device provides a reduced amount of inlet air and is used only for a gasoline engine of the carburetor type.

In order to avoid such problems, the invention of U.S. Pat. No. 4,962,642 issued to the present inventor was developed which discloses an air flow system for an internal combustion engine comprising an air cleaner and a swirling device disposed there, having a plurality of vanes for causing the air to swirl, thereby improving the properties of the air-fuel mixture and the performance of the engine. Also, in order to eliminate such prior art problems, U.S. Pat. No. 5,113,838, issued to the present inventor, was obtained which discloses an air flow system for an internal combustion engine comprising an air cleaner and a swirling device disposed therein, having a plurality of vanes which contain at least one elongated slit for further causing the air to swirl, thereby improving the performance of the engine. However, air flow systems generally create a negative pressure disposed behind the plurality of vanes and the friction caused by the swirl of the air produces several disadvantages, such as for example, a decrease in the intake air, lower power, and not much in the way of fuel savings.

SUMMARY OF THE INVENTION

Accordingly, it is an object of the present invention to provide an improved air flow system for an internal combustion engine, which eliminates the above problems encountered with conventional air flow systems for an internal combustion engine.

Another object of the present invention is to provide an air swirling device located in an air cleaner, the air swirling device having a plurality of slitted vanes with at least one groove disposed therein. Therefore, one advantage of the air swirling device of the present invention is that it minimizes the restriction of air flow, causes the fuel to stay in the center part of the swirling air, prevents adherence of the fuel to the walls of the intake system and avoids the generation of negative pressure behind the vanes. This provides for a good mixture of air and fuel, creating good evaporation with a fine, uniform fuel particle size which improves acceleration of the vehicle driven by the engine. If there is a slight pedal acceleration, the amount of the injected fuel is lower thereby resulting in fuel savings.

Other objects and further scope of applicability of the present invention will become apparent from the detailed description given thereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to an air flow system for an internal combustion engine comprising an air cleaner and a swirling device having a plurality of vanes with at least one elongated slit disposed therein, and with at least one groove having a concave configuration disposed thereon. The slits and grooves are disposed around the center of the air cleaner for causing the air to swirl. The air cleaner preferably has a cylindrical shape and the swirling device controls the air outwardly from a control area toward the air cleaner. Thus, the vanes of the swirling device have at least one elongated slit and at least one groove disposed therein for increasing air flow through the air cleaner and to reduce air flow resistance.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a cross-sectional view of an air flow system for a gasoline, internal combustion engine according to the present invention;

FIG. 2 is a perspective view according to the present invention of an air flow distribution device utilized in an air flow system of an internal combustion engine;

FIG. 3(A) shows the distribution of the air flow stream through a conventional air flow system;

FIG. 3(B) shows the distribution of the air flow stream through the air distribution device of the present invention;

FIGS. 4(A) and 4(B) are front and sectional views of the air flow vanes utilized in the distribution device of the present invention;

FIGS. 5(A) and 5(B) are front and sectional views of a second embodiment of the air flow vanes utilized in the air distribution device of the present invention;

FIGS. 6(A) and 6(B) are front and sectional views of a third embodiment of the air flow vanes utilized in the distribution device of the present invention;

FIGS. 7(A) and 7(B) are front and sectional view of a fourth embodiment of the air flow system according to the present invention;

FIGS. 8(A) and 8(B) are front and sectional view of a fifth embodiment of the air flow system according to the present invention;

FIGS. 9(A) and 9(B) are front and sectional view of a sixth embodiment of the air flow system according to the present invention;

FIGS. 10 (A) and 10(B) are front and sectional view of a seventh embodiment of the air flow system according to the present invention; and FIGS. 11(A) and 11(B) are front and sectional view of an eighth embodiment of the air flow system according to the present invention.

DETAILED DESCRIPTION OF THE PREFERRED EMBODIMENTS

Referring now in detail to the drawings for the purpose of illustrating preferred embodiments of the present invention, the air flow system for an internal combustion engine as shown in the figures includes an air cleaner 2 having a centrally disposed air swirling zone and a laterally disposed filter zone. A swirling device 10 having a plurality of vanes 11 containing at least one elongated slit 12 and at least one groove or concave area 13 is disposed in the air swirling zone. The vanes are disposed around the center of the air cleaner 2 for causing the air to swirl. The swirling device 10 may be made of many types of flexible materials, e.g. metals such as stainless steel, various types of plastics, and the like.

The air cleaner 2 is operatively associated with an engine body of a gasoline engine through a carburetor 4 and an intake manifold (FIG. 1). The engine body is associated with an exhaust manifold. The swirling device 10 is inserted into the inside of the air cleaner 2 by a bolt and a wing nut (not shown).

FIGS. 2, 4(A), and 4(B) show the use of a plurality of grooves 13. For example, two pair of grooves 13 are located on the top surfaces and positioned on the outside of each vane 11. Accordingly, since the vane 11 has a predetermined thickness, there is a convex portion 13' disposed on the bottom surface of the vane 11 as shown in FIG. 3(B).

As shown in FIGS. 4(A), 4(B), 5(A), 5(B), 6(A), 6(B), 7(A), 7(B), 8(A), 8(B), 9(A), 9(B), 10(A), 10(B), 11(A), and 11(B), each of the vanes 11 has at least one elongated slit 12. The slit 12 numbers 1 to 6 and is vertically or horizontally located in the vanes 11. Furthermore, each of vanes 11 has at least one concave portion 13 disposed on the top surface thereof. The concave members 13 number 2 to 12.

Also, the concave member 13 has a round configuration as shown in FIGS. 4(A), 5(A), 6(A), 7(A), and 11(A), and an elongated configuration as shown in FIGS. 8(A), 9(A), and 10(A) Particularly, as shown in FIGS. 8(A) and 9(A), one pair or two pairs of elongated concave members 13 are located in the opposite direction of the elongated slits 12 for improving the swirling force of the air flow. Also, at least one convex member 13 is disposed on the surface of the bottom of the vanes 11 for helping the air flow swirling system.

As shown in FIG. 1, the air flow system for an internal combustion engine according to the present invention operates as follows. When the pistons and intake valves move downward, air flow filtered by the air cleaner 2 is swirled by the vanes 11 of the air flow swirling device 10 due to a reduced pressure in the combustion chamber.

At this time, in the carburetor 4 fuel particles are gathered in the center of the swirling air flow, causing fuel and air to uniformly mix. The swirling air flow center moves very fast so that the fuel does not adhere to the walls of the intake conduit, which results in good engine and accelerator pedal response. Also, since the swirling air flow is continuously maintained in the combustion chamber, the swirling air flow is also continuously maintained in the exhaust manifold. Therefore, in the combustion chamber, the flame is scattered very well and the fuel is completely burned, thereby preventing noise, vibration and abrasion and causing a longer engine life and stronger engine power.

As shown in FIGS. 2 and 4(A), the air flow swirling device 10 having a plurality of vanes 11 can be positioned between the carburetor 4 and intake manifold, in the same direction, for increasing the swirling air flow force which may be reduced while the swirling air passes the carburetor 4.

As shown in FIG. 1, an additional swirling device can be inserted in the exhaust manifold entrance, in the same direction, for improving the swirling of the exhaust gas. Furthermore, the swirling exhaust gas prevents back-pressure resulting in complete exhaustion and a stronger intake force.

As shown in FIG. 3(B), the air flow stream according to the present invention prevents the generation of negative pressure behind the plurality of vanes 11. However, the air flow stream according to conventional air flow systems generate a negative pressure buildup behind the plurality of vanes 3 as shown in FIG. 3(A).

Referring to FIGS. 5(A) and 5(B), the air flow device 10, according to the present invention, shows that each vane 11 has three horizontal, elongated slits 12 and four pairs of concave members 13. In this embodiment, each pair of concave members 13 is located between the slits 12 and positioned on the outside of the vanes 11 for increasing the air swirling force. As shown in FIGS. 6(A) and 6 (B), three pairs of concave members 13 are located between two horizontal slits 12 for improving the force of the swirling air flow.

Referring to FIGS. 7(A), 7(B), 10(A), 10(B), 11(A), and 11(B), the vanes 11 have an hour-glass styled configuration containing a plurality of inclined, elongated slits 13 for increasing the swirling force of the air flow. There are six elongated slits 12 and eight concave members 13 located on the outside of the vanes 11 as shown in FIGS. 7(A) and 7(B). There are twelve concave members 13 shown in FIGS. 11(A) and 11(B) and four elongated concave members 13 shown in FIGS. 10(A) and 10(B).

Referring to FIGS. 8(A), 8(B), 9(A), and 9(B), the vanes 11 have a pair of horizontally elongated slits 12 which have a pair of vertical concave members 13 as shown in FIGS. 8(A) and 8(B) and two pairs of vertical concave members 13 as shown in FIGS. 9(A) and 9(B) for increasing the swirling force of the air flow.

Accordingly, the air flow swirling device for use in an internal combustion engine of a vehicle provides that the user drives with the air conditioner on in hilly terrain to feel the cold starts and greater sensitivity in the accelerator at high speeds notice the reduction in engine noise and vibration, and the user will save fuel. Thus, in normal city driving, the user will see up to a 10% improvement in fuel efficiency and a 20% improvement in efficiency under highway driving conditions.

Also, during operation, the air intake valve continuously opens and closes. When the valve is closed, the force of the revolution inertia produces a high density of air which surges into the combustion chamber when the valve opens. During combustion, the flame is scattered and the fuel is completely combusted thereby producing a uniform, downward force on the piston. The uniform, downward force prevents noise vibration and abrasion, thereby producing stronger engine power and longer engine life. The fast combustion is useful with advance spark timing and results in leaner combustion, lower air pollution and fuel savings. The combustion products (carbon and oxides) are concentrated in the center of the combustion chamber and can be easily exhausted to prevent carbon accumulation in the combustion chamber which could cause engine abrasion and knocking. The swirling action may continue in the same direction without any intake resistance as the gas leaves the combustion chamber. When the swirling device having the plurality of vanes with at least one elongated slit disposed therein, respectively, is placed in the air cleaner, the carbon monoxide (CO) gas level can be reduced by up to 50% at engine idle speed, the engine power can be increased up to 13%, the fuel economy can be improved by up to 24% and nitrous oxides (NO) can be reduced by up to 48%.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An air flow system for an internal combustion engine which comprises:

a cylindrical air cleaner, said cylindrical air cleaner divided into a centrally disposed air swirling zone and a laterally disposed filter zone; and a swirling device disposed in said air swirling zone, said swirling device including:

a plurality of vane members which extend radially toward the periphery of the swirling device for increasing air flow, at least one elongated slit disposed in each of said plurality of vane members for preventing the generation of negative pressure behind the vane members, and at least one groove disposed on the surface of each of said plurality of vane members for preventing the generation of negative pressure behind the vane members and increasing the force of the swirling air flow, whereby when air is introduced through said filter zone and into said air swirling zone, a strong swirling force is generated which is retained by the reduced resistance created in the air flow through the vane members.

2. The air flow system of claim 1, wherein each of the vane members contains up to six elongated slits which are disposed in a vertical, horizontal or canted direction or in a combination thereof.

3. The air flow system of claim 2, wherein each of the vane members contain up to twelve grooves which are disposed on one side of the slits or mixed with the slits.

4. The air flow system of claim 1, wherein the grooves are configured as semi-spherical or elongated.

5. The air flow system of claim 1, further comprising a second swirling device disposed near the entrance to the intake manifold to provide an air swirl in the same direction as said first air swirling device.

6. The air flow system of claim 1, wherein said engine is a gasoline or diesel engine.

7. The air flow system of claim 1, wherein said swirling device includes a central portion spaced from an opening in the bottom of said air cleaner and said vane members extend from said central portion toward said bottom of said air cleaner whereby said swirling device surrounds said opening in the bottom of said air cleaner.

8. The air flow system of claim 1, wherein said grooves are disposed on the top or bottom surface of the vanes.

9. The air flow device of claim 1, wherein said vane members are disposed inside of said air cleaner element.

10. The air flow device of claim 1, wherein said swirling device is formed from a single piece of metal or a plurality of pieces of metal.

11. A swirling device for use in an air cleaner of an internal combustion engine which comprises:

a cylindrical air cleaner, said cylindrical air cleaner divided into a centrally disposed air swirling zone and a laterally disposed filter zone; and a swirling device disposed in said air swirling zone, said swirling device including:

a plurality of vane members which extend radially toward the periphery of the swirling device for increasing air flow, at least one elongated slit disposed in each of said plurality of vane members for preventing the generation of negative pressure behind the vane members, and at least one groove disposed on the surface of each of said plurality of vane members for preventing the generation of negative pressure behind the vane members and increasing the force of the swirling air flow, whereby when air is introduced through said filter zone and into said air swirling zone, a strong swirling force is generated which is retained by the reduced resistance created in the air flow through the vane members.

12. The air flow device of claim 1, wherein the vane members are flexible or inflexible.

13. The swirling device of claim 11, wherein the vane members are flexible or inflexible.

* * * * *